US008444302B1

(12) United States Patent
Barboza et al.

(10) Patent No.: US 8,444,302 B1
(45) Date of Patent: May 21, 2013

(54) PIVOTING RECESSED LIGHT FIXTURE

(75) Inventors: Michael Barboza, Jacksonville, FL (US); Kenneth Knopf, Jacksonville, FL (US)

(73) Assignee: Interline Brands, Inc., Jacksonville, FL (US)

( * ) Notice: Subject to any disclaimer, the term of this patent is extended or adjusted under 35 U.S.C. 154(b) by 109 days.

(21) Appl. No.: 12/773,076

(22) Filed: May 4, 2010

Related U.S. Application Data

(60) Provisional application No. 61/175,205, filed on May 4, 2009.

(51) Int. Cl.
*F21V 15/00* (2006.01)

(52) U.S. Cl.
USPC ..... 362/365; 362/270; 362/269; 362/427

(58) Field of Classification Search
USPC ..... 362/364, 365, 427, 270, 269, 366
See application file for complete search history.

(56) References Cited

U.S. PATENT DOCUMENTS

| | | | | |
|---|---|---|---|---|
| 3,313,931 | A * | 4/1967 | Klugman | 362/366 |
| 4,041,657 | A * | 8/1977 | Schuplin | 52/39 |
| 5,588,737 | A * | 12/1996 | Kusmer | 362/148 |
| 5,678,794 | A | 10/1997 | Kump | |
| 5,690,423 | A | 11/1997 | Hentz et al. | |
| 5,803,585 | A | 9/1998 | Littman et al. | |
| 5,957,573 | A * | 9/1999 | Wedekind et al. | 362/365 |
| 6,033,098 | A * | 3/2000 | Hentz et al. | 362/430 |
| 6,089,732 | A * | 7/2000 | Wright et al. | 362/364 |
| 6,123,438 | A * | 9/2000 | Hentz | 362/373 |
| 6,161,336 | A * | 12/2000 | Ziv-Av | 49/260 |
| 6,176,599 | B1 * | 1/2001 | Farzen | 362/365 |
| 6,461,016 | B1 * | 10/2002 | Jamison et al. | 362/147 |
| 6,511,208 | B1 * | 1/2003 | Kotovsky | 362/285 |
| 7,234,674 | B2 * | 6/2007 | Rippel et al. | 248/343 |
| 7,320,533 | B1 * | 1/2008 | Beadle | 362/285 |
| 2008/0192490 | A1 * | 8/2008 | Brown et al. | 362/365 |
| 2008/0304269 | A1 * | 12/2008 | Pickard et al. | 362/365 |

FOREIGN PATENT DOCUMENTS

| | | |
|---|---|---|
| CA | 2 618 677 | 3/1999 |
| CA | 2 216 418 | 4/2008 |

* cited by examiner

*Primary Examiner* — Jong-Suk (James) Lee
*Assistant Examiner* — Bryon T Gyllstrom
(74) *Attorney, Agent, or Firm* — Smith Gambrell & Russell LLP

(57) ABSTRACT

A pivoting recessed light fixture has a can and junction box mounted on a frame structure. The frame structure is pivotally supported near one of its ends between a pair of telescoping support rails mounted between a pair of support members. The other end of the frame structure is removably attached to each of the support rails so that the frame structure, with its can and junction box, can be pivoted below the rails to allow access for wiring during installation.

7 Claims, 5 Drawing Sheets

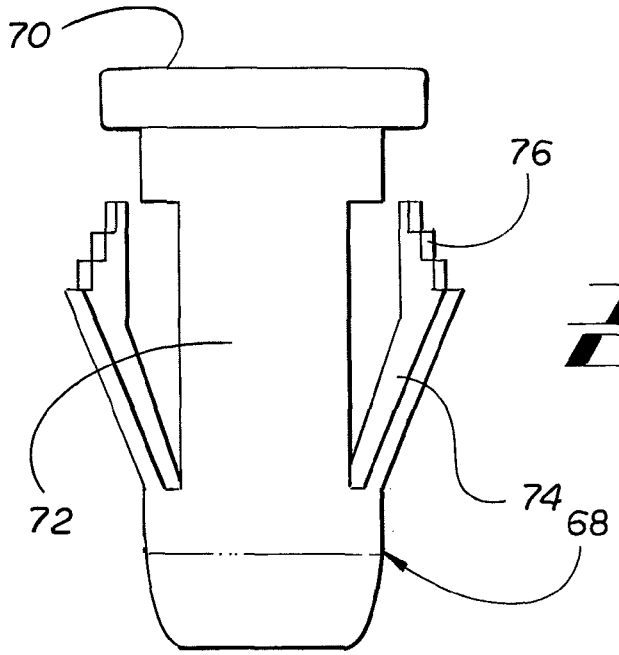
Fig_4
Fig_5
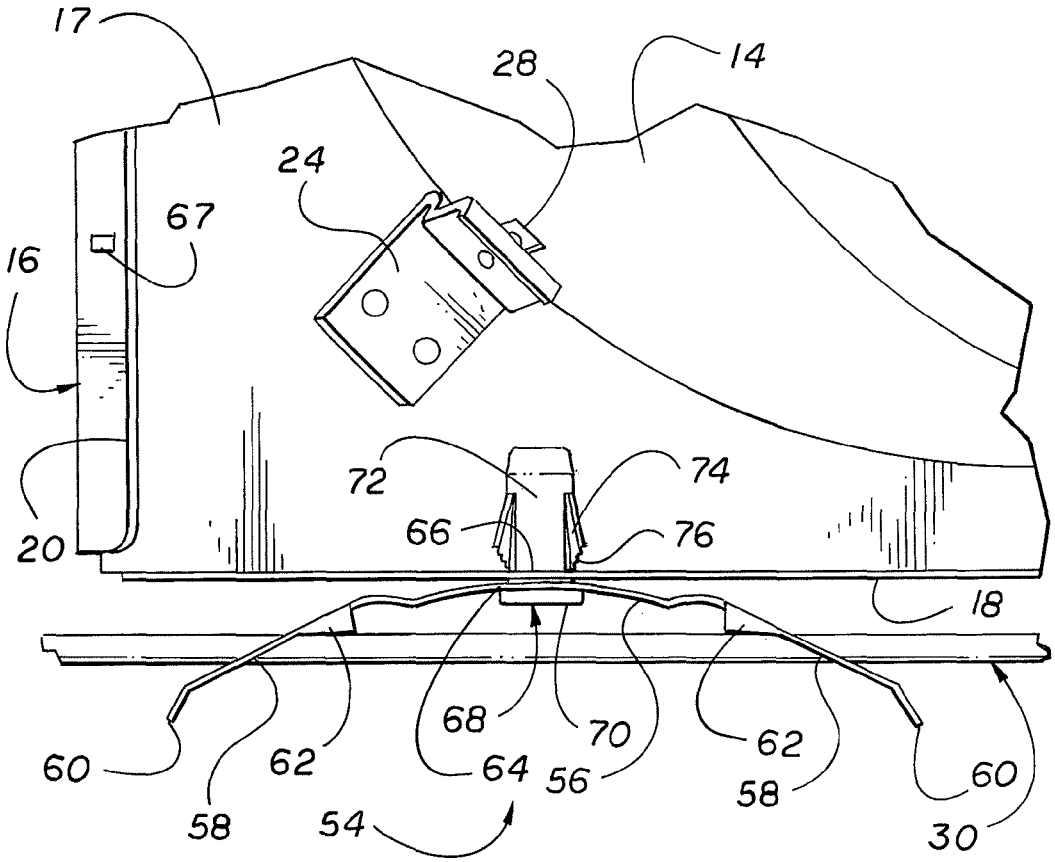

PIVOTING RECESSED LIGHT FIXTURE

CROSS REFERENCE TO RELATED PATENT APPLICATIONS

This patent application claims priority from U.S. Provisional Patent Application No. 61/175,205, filed May 4, 2009, which is hereby incorporated by reference.

FIELD OF THE INVENTION

This invention relates to a recessed light fixture and more particularly to a recessed light fixture in which a can or housing pivots with respect to mounting rails to allow access for wiring and adjustment after the mounting rails have been attached to a pair of support members, such as ceiling joists or the grid structure of a suspended ceiling.

BACKGROUND OF THE INVENTION

A conventional recessed light fixture typically includes a pair of telescoping support rails that are attached to a pair of support members, such as ceiling joists or the grid structure of a suspended ceiling. A can or housing encloses a light socket and a reflector and is attached to the rails by a frame structure, such as a support band or plaster tray. A junction box for connecting the wires to the socket of the recessed light fixture is also attached to the frame structure. When such a conventional recessed light fixture is installed, the telescoping rails are extended or retracted to fit the space between the pair of support members, and the support rails are then attached to the support members by means of nails, screws, integral chevron-shaped spikes, clips, or other known fasteners. Once the conventional recessed light fixture is mounted in place between the support members, the installer must then feed the electrical supply wires into the junction box and connect the electrical supply wires to the electrical wires of the recessed light fixture. The manipulation of the electrical wires to make the electrical connection must be accomplished by reaching into the space between the support members and above the support rails of the recessed light fixture. Such space is often small and difficult to access making the wiring installation difficult.

In order to address the installation difficulty described above, Wedekind et al. U.S. Pat. No. 5,957,573 discloses a recessed light fixture in which a pair of support rails have hinged rail brackets at one end of each support rail. During the first phase of installation, the hinged rail brackets are connected by an installer to one of the support members. The weight of the recessed light fixture causes the recessed light fixture to pivot to a position where of the recessed light fixture is hanging by the support rails from hinged rail brackets attached to the one support member. During the second phase of installation, an electrician connects the electric supply wires to a junction box on the recessed light fixture while the recessed light fixture is hanging from the hinged rail brackets. During the third phase of installation, the installer must return to connect the opposite ends of the support rails to the second support structure. While the prior art recessed light fixture with hinged rail brackets gives access to the junction box for installation of the electrical wiring, the recessed light fixture with hinged rail brackets creates other problems both in terms of complexity of the prior art recessed light fixture and in terms of efficiency for the installer and electrician. In order to ensure that the telescoping rails of the prior art recessed light fixture do not separate under the weight of the recessed light fixture, a complicated locking mechanism must be provided at the hinged rail brackets to lock the telescoping rails when they are pivoted to the hanging position and to unlock the telescoping rails when they are raised to the upright position between the pair of support members. In addition, the installation of the prior art recessed light fixture requires three separate operations generally employing differently skilled installers. Typically, the recessed light fixtures of the Wedekind patent are mechanically attached to the first support member by an electrician's apprentice or helper, who installs all of the recessed light fixtures at one time. Next, the electrician wires all of the recessed light fixtures. Once the recessed light fixtures have been wired, the apprentice or helper must return and connect the other end of the support rails to the other support member, thereby adding an additional step with its concomitant cost and scheduling issues.

SUMMARY OF THE INVENTION

The present invention addresses the deficiencies of the prior art recessed light fixtures. The pivoting recessed light fixture of the present invention has a pair of telescoping support rails with brackets at both ends that attach the support rails to the support members, such as ceiling joists or metal grid structures for a suspended ceiling. A can or housing for a light socket and a reflector is attached to a generally rectangular frame structure, commonly referred to as a plaster tray. In addition, a junction box is also attached to the frame structure. The frame structure has a generally rectangular base and upstanding side walls around its periphery.

The frame structure is pivotally connected near one of its ends to the support rails by means of a pivot assembly on each side of the frame structure. Each pivot assembly includes a spring fastener that is slidably connected to each of the support rails. Each spring fastener has a center hole which aligns with a matching frame hole in each of the upstanding side walls of the frame structure near one end of the frame structure. A removable pivot pin interconnects each of spring fastener's center holes with each of the frame holes in the frame structure so that the frame structure, with mounted can and junction box, is free to pivot through an arc of greater than 90° with respect to the stationary support rails. In one embodiment, stops are provided in the stationary support rails or in the frame to limit the rotation of the frame structure to less than 90°. Because the pivot pin is removable, the generally rectangular frame structure can be rotated 90°, 180°, or 270° (as seen from the top of the recessed light fixture) with respect to support rails thereby accommodating different rail spacing and location of the frame structure between the support members.

A rail clip is fixed to the frame structure on each side of the frame structure and located at the end of the frame structure opposite from the pivot assemblies. In one embodiment, the rail clip is generally U-shaped with an inside leg and an outside leg. Each leg has a flared end allowing the legs to open and engage the support rail from the bottom. In one embodiment, the rail clip is a separate clip attached to the upstanding side walls of the frame structure. In another embodiment the rail clip is formed from punching out a section of the upstanding side walls of the frame structure. In yet another embodiment the rail clip comprises a hook attached to the upstanding side walls of the frame structure and engaging the top of each of the support rails to hold the frame structure, with its mounted can and junction box, in the upright position. The hook may be either a separate hook or may be punched from a portion of the upstanding side wall of the frame structure.

Further objects, features and advantages will become apparent upon consideration of the following detailed description of the invention when taken in conjunction with the drawings and the appended claims.

BRIEF DESCRIPTION OF THE DRAWINGS

FIG. 4 is a detailed elevation view of a removable pivot pin for use with the pivoting recessed light fixture in accordance with the present invention.

FIG. 5 is a detailed top plan view of a pivot assembly for use with the pivoting recessed light fixture in accordance with the present invention.

DETAILED DESCRIPTION OF THE PREFERRED EMBODIMENTS

Figure 1:
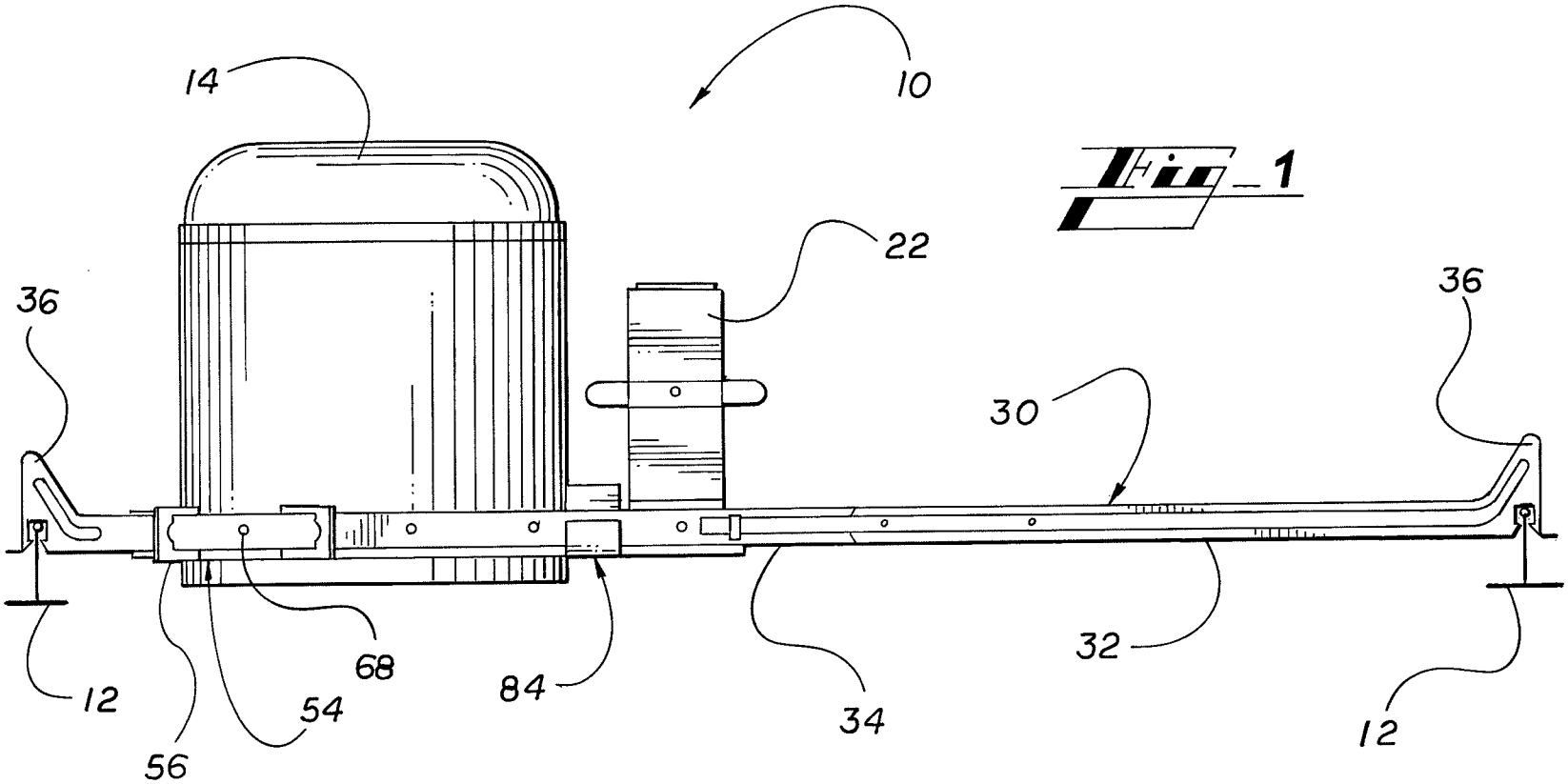
FIG. 1 is a side elevation view of a pivoting recessed light fixture showing the light fixture in its upright, installed position in accordance with the present invention.
Figure 2:
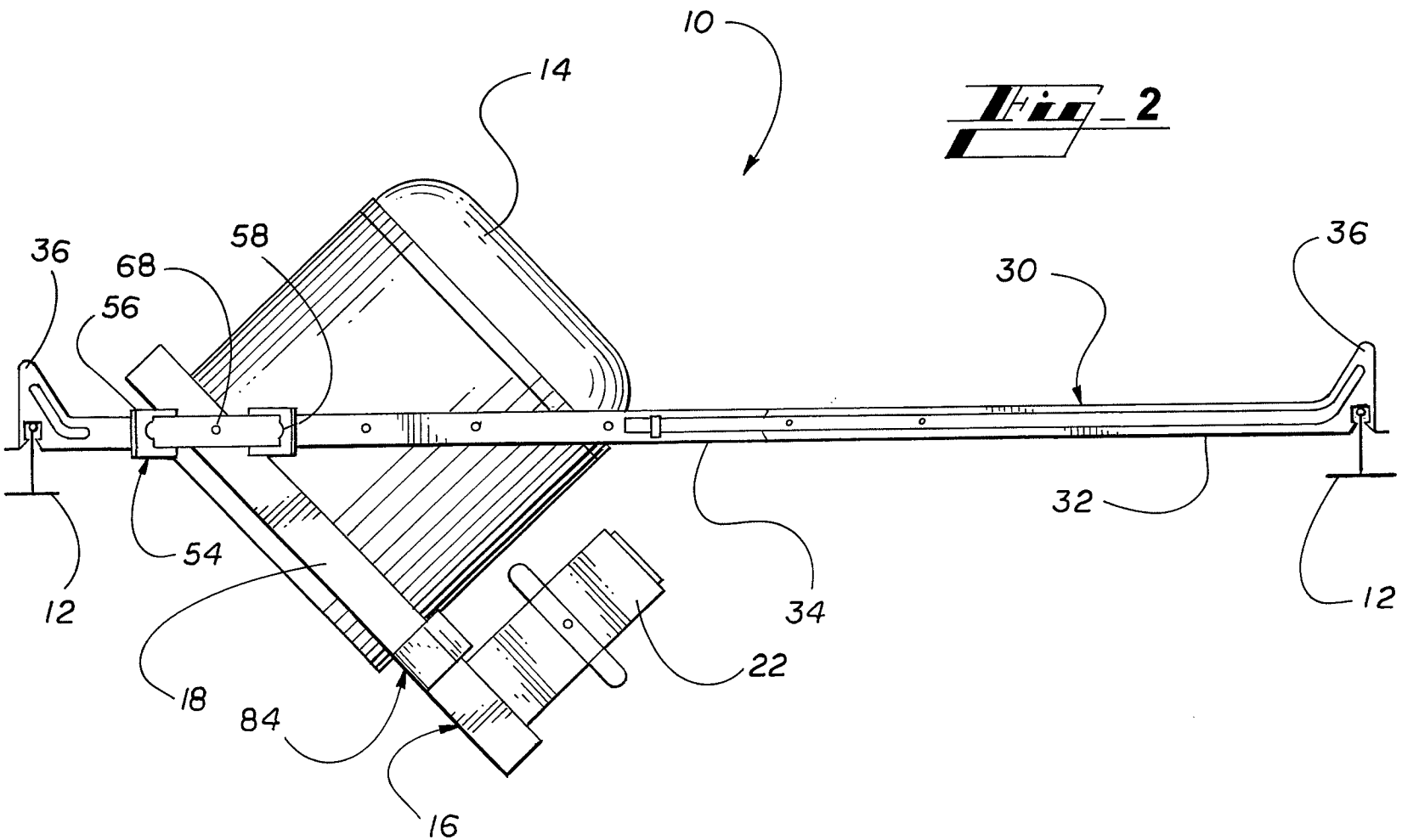
FIG. 2 is a side elevation view of the pivoting recessed light fixture showing the light fixture in its lowered position in accordance with the present invention.
Figure 3:
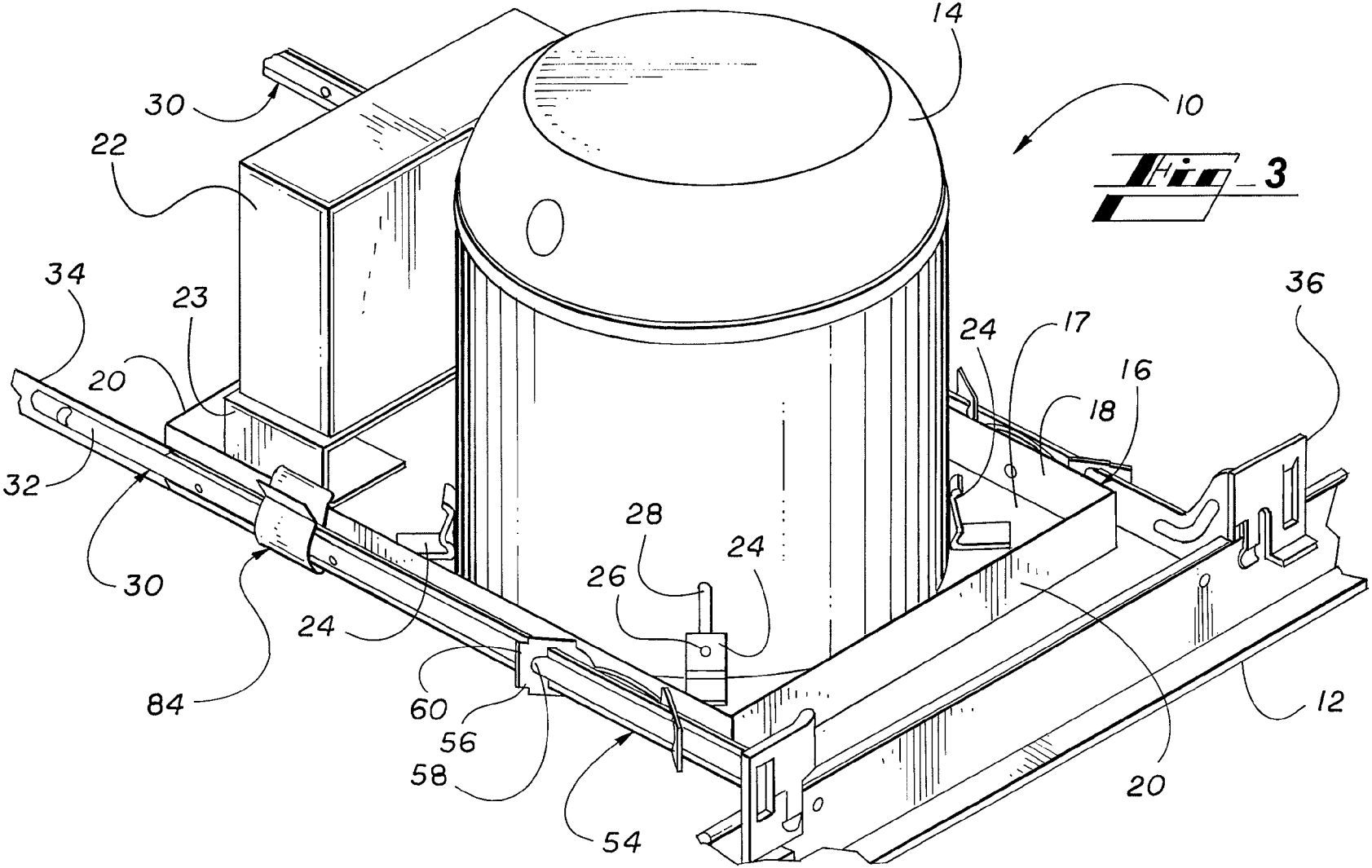
FIG. 3 is a perspective view of the pivoting recessed light fixture in accordance with the present invention.

Turning to FIGS. 1-3, a recessed light fixture 10 comprises a can or housing 14, a junction box 22, a frame structure 16, commonly referred to as a plaster tray, and a pair of telescoping support rails 30. The can 14, the junction box 22, and the frame structure 16 are generally conventional in design. An electric socket and a reflector (not shown) are mounted inside the can 14 in conventional fashion. Electric wiring (not shown) extends from the electric socket to the junction box 22. The frame structure 16, best shown in FIG. 3, comprises a generally rectangular base 17, upstanding long side walls 18, and upstanding short side walls 20. The rectangular base 17, the upstanding long side walls 18, and the upstanding short side walls 20 together form a tray that serves to support plaster applied to a ceiling after the recessed light fixture is installed. The can 14 is mounted on the base 17 of the frame 16 by means of L-shaped brackets 24, can slots 28, and can screws 26 connecting the can slots 28 to the L-shaped brackets 24. The can slots 28 allow for vertical adjustment of the can 14 with respect to the frame structure 16 (i.e. adjustment in a direction normal to the plane of the plaster tray base 17). The electrical junction box 22 is mounted on the plaster tray base 17 by means of base standoffs 23 that are punched from the material of the plaster tray base 17.

With continuing reference to FIGS. 1-3, a pair of telescoping support rails 30 are mounted between horizontal support members 12. The horizontal support members 12 may be parallel wooden ceiling joists, or as shown in FIGS. 1-3, the horizontal support members 12 may be metal frame members that make up the metal grid structure for a conventional suspended ceiling. Each telescoping support rail 30 comprises a bar section 32 slidably inserted within a channel section 34. The relative sliding between the bar section 32 and the channel section 34 allows the support rails 30 to be extended and retracted to fit the space between the horizontal support members 12. Rail brackets 36 are formed at the ends of the support rails 30. The rail brackets 36 are generally conventional in design and provide universal connection to the metal horizontal support members 12 by a clip as shown in FIGS. 1-3 or to a wooden ceiling joist by a captured nail or punched out chevron-shaped tab.

The frame structure 16, with the mounted can 14 and junction box 22, is connected to the telescoping support rails 30 by means of a pair of rail pivot assemblies 54 at one end of the frame structure 16 and a pair of rail clips 84 at the other end of the frame structure 16. FIG. 1 shows the frame structure 16, with the mounted can 14 and junction box 22, in its upright, installed position with the rail clips 84 engaging the support rails 30. FIG. 2 shows the frame structure 16, with the mounted can 14 and junction box 22, in its lowered position allowing access to the junction box 22 below the level of the support members 12.

Referring to FIG. 5, each rail pivot assembly 54 comprises a sliding spring fastener 56 with rail engaging openings 58 that slidably engages the support rail 30. Secondary openings (not shown) may be provided in the sliding spring fastener 56 between the rail engaging openings 58 to ensure proper engagement with the smaller first rail section 32. The sliding spring fastener 56 also includes thumb tabs 60 and rail engaging surfaces 62. In addition, each rail pivot assembly 54 includes a fastener center hole 64 in the sliding spring fastener 56 that aligns with a frame hole 66 in the upstanding long side wall 18 of the frame 16. The sliding spring fastener 56 is connected to the upstanding long side wall 18 of the frame 16 by means of a removable pivot pin 68. The pivot pin 68 shown in detail in FIG. 4 comprises a pin head 70, a pin shank 72, and pin wings 74 with ratcheted ends 76. The pivot pin 68 is pushed into the fastener center hole 64 and through the frame hole 66. The pressure exerted on the pivot pin 68 by the fastener center hole 64 and the frame hole 66 compresses the pin wings 74 until the first part of the ratchet end 76 clears the frame hole 66. At that point, the pin wings 74 open to lock the pivot pin in position. The pivot pin may be removed at a later time by compressing the pin wings 74 to allow the wings to clear the frame hole 66 and the fastener center hole 64. The pivot pin 68 may also be implemented by a conventional metal pin with a c-shaped retaining clip. Further, a stop may be formed in the support rail 30 or in the frame 16 to limit the rotation of the frame 16 about the pivot pin 68 to less than 90°.

Figure 6:
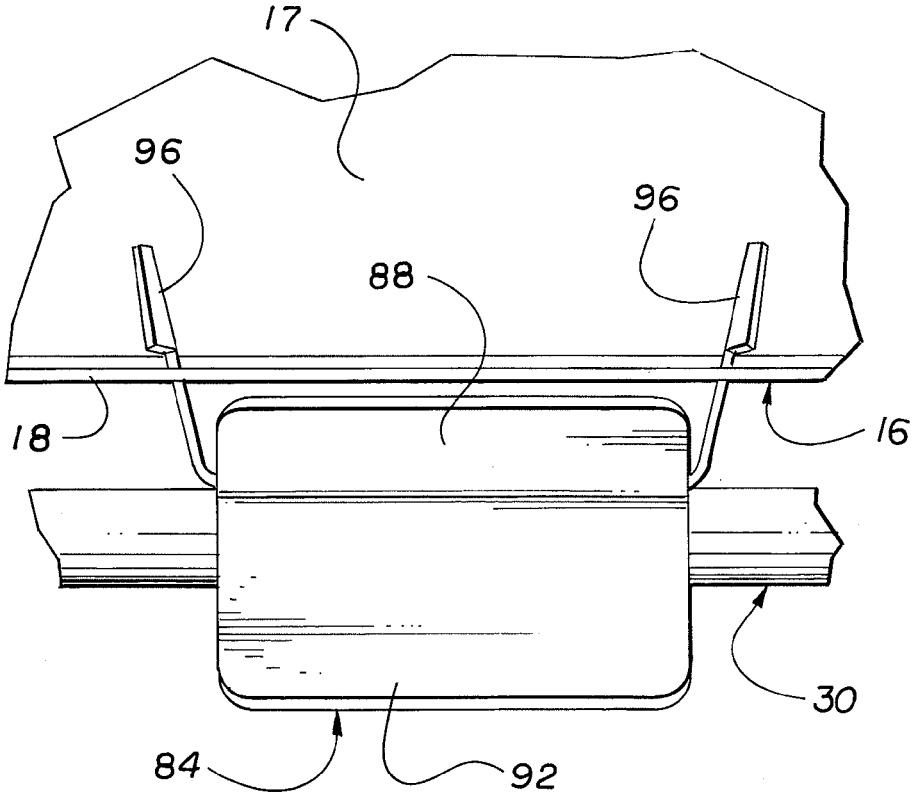
FIG. 6 is a detailed top plan view of a rail clip for use with the pivoting recessed light fixture in accordance with the present invention.
Figure 7:
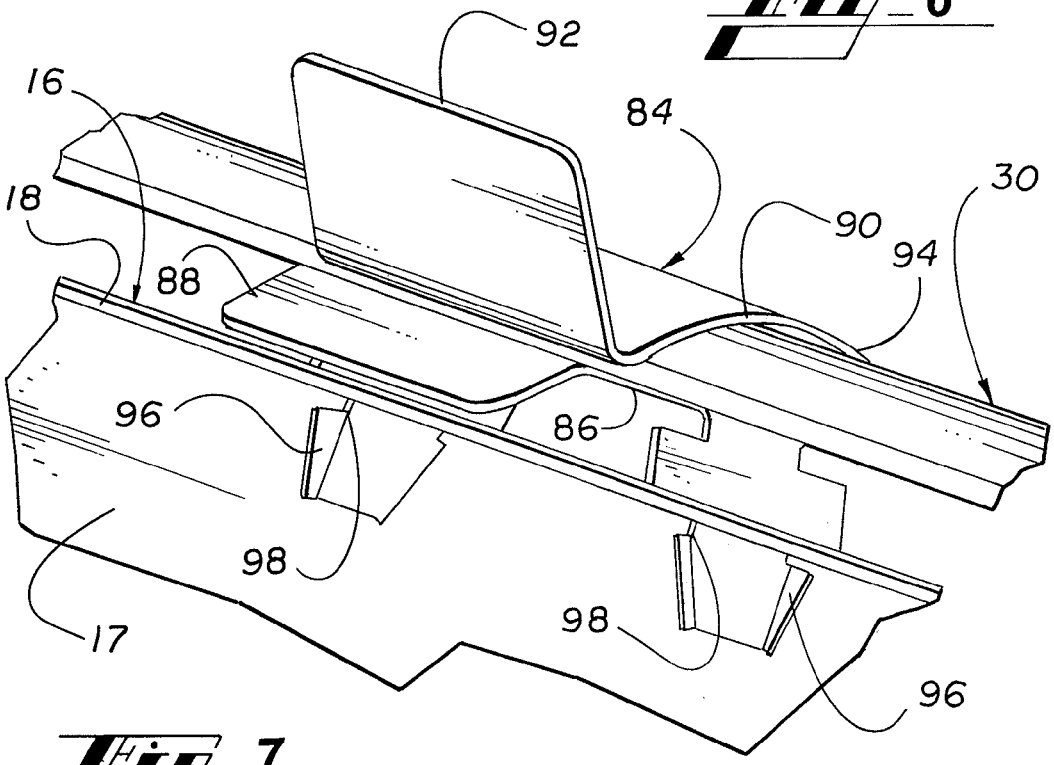
FIG. 7 is a detailed perspective view of the rail clip for use with the pivoting recessed light fixture in accordance with the present invention.

Referring to FIGS. 6 and 7, each rail clip 84 releasably connects one end of the frame structure 16 to the support rail 30. Each rail clip 84 comprises an inside clip leg 86 and an outside clip leg 90. The inside clip leg 86 and the outside clip leg 90 are joined by an interconnecting web 94. The inside clip leg 86 has a flared end 88, and the outside clip leg 90 has a flared end 92. The interconnecting web 94 has frame engaging clip tabs 96 that engage slots 98 in the upstanding long side wall 18 on each side of the frame structure 16. When the frame structure 16, with the mounted can 14 and the junction box 22, is in the upright, installed position (FIG. 1), each of the rail clips 84 engages each of the support rails 30. In order to pivot the frame structure 16, with the mounted can 14 and junction box 22, to the lowered position (FIG. 2), the installer spreads the inside leg 86 and the outside leg 90 to release the rail clips 84 from the support rails 30 and allow the frame structure 16 to pivot about pivot pins 68. To returned the frame structure 16 to its upright, installed position, the installer pivots the frame structure 16 about pivot pins 68 to bring the flared ends 88 and 92 into contact with the lower side of the support rails 30. The upward pressure by the installer on the frame structure 16 causes the flared ends 88 and 92 to spread the legs 86 and 90 and thereby allowed the rail clips 84 to reengage the support rails 30 and hold the frame structure 16, with the mounted can 14 and the junction box 22, in the upright, installed position (FIG. 1).

In addition to the separate rail clips 84 attached to the upright side walls 18 as shown in FIGS. 6 and 7, the rail clips could be punched from the upright side walls 18. In addition, the rail clips could take the form of a wire hook attached to the upright side walls 18.

As shown in FIGS. 1-2, the frame structure 16 is attached to the support rails 30 by inserting the pivot pins 68 through the frame holes 66 in the upstanding long side walls 18 so that the pivot pins 68 are located near the left end of the support rails 30. In that configuration, the frame structure 16 pivots downward in a clockwise direction as shown in FIGS. 1 and 2. Alternatively, the pivot pins 68 can be removed, and the frame structure 16 can be rotated 180° (as seen from the top of the recessed light fixture 10) so that the pivot pins 68 are located near the right end of the support rails 30, and the frame structure 16 pivots downward in a counterclockwise direction when shown from the perspective of FIGS. 1 and 2. In yet another alternative, the pivot pins 68 can be removed, the frame structure 16 can be rotated 90° (as seen from the top of the recessed light fixture 10), the rails 30 can be repositioned to a wider spacing, and the pivot pins 68 are inserted into frame holes 67 in the upstanding short side walls 20 of the frame structure 16.

In connection with the installation of the recessed light fixture 10 of the present invention, the installer first determines whether the pivot pins 68 will engage the frame holes 66 in the upstanding long side walls 18 or will engage the frame holes 67 in the upstanding short side walls 20. Once the frame structure 16, with the mounted can 14 and junction box 22, is connected by means of the pivot pins 68 to the support rails 30, the installer attaches the rails 30 to the support members 12 by means of the rail brackets 36. As previously discussed, the rail brackets 36 allow connection either to wooden ceiling joists or to metal grid structures for suspended ceilings as shown in FIGS. 1-3. Once the support rails 30 have been connected to the support members 12, the installer can disengage the rail clips 84 to allow the frame structure 16 to pivot about pivot pins 68 to the lowered position shown in FIG. 2. As configured, the frame structure 16 can rotate more than 90° with respect to the support rails 30, or in the alternative, stops may be installed on either the support rails 30 or the frame structure 16 to limit the rotation of the frame structure 16 to less than 90°. In the lowered position shown in FIG. 2, the electrician has easy access to the junction box 22 below the level of the ceiling for easy wiring of the recessed light fixture 10. Once the wiring has been completed, the electrician merely rotates the frame structure 16 counterclockwise so that the rail clips 84 can reengage the support rails 30 to complete the wiring installation as shown in FIG. 1.

In order to complete the full installation, horizontal adjustment of the frame structure 16, with the mounted can 14 and junction box 22, along the support rails 30 may be required. In order to move the frame 16 horizontally along the support rails 30, the installer must be able to slide the frame structure 16 with respect to the support rails 30. In order to slide the frame 16 along the support rails 30, the installer squeezes the thumb tabs 60 of each of the spring fasteners 56. Squeezing the thumb tabs 60 relieves the pressure between the engaging surfaces 62 and the support rails 30 so that the sliding spring fasteners 56 can slide along the support rails 30. Conversely, when the installer releases the thumb tabs 60, the sliding spring fasteners 56 reapplies pressure between the rail engaging surfaces 62 and the support rails 30 to lock the sliding spring fasteners 56 and therefore the frame structure 16 at a selected horizontal position along the length of the support rails 30.

The recessed light fixture 10 of the present invention allows the mechanical attachment of the recessed light fixture 10 to the support members 12 to be completed in one step. Further, because the frame structure 16, with the mounted can 14 and junction box 22, can be rotated into the lowered position (FIG. 2) at any time, subsequent repair or rewiring of the recessed light fixture 10 can be accomplished without detaching the support rails 30 from the support members 12.

While this invention has been described with reference to preferred embodiments thereof, it is to be understood that variations and modifications can be affected within the spirit and scope of the invention as described herein and as described in the appended claims.

We claim:

1. A pivoting recessed light fixture comprising:

a. a pair of support rails having a length;

b. a rectangular frame structure, the frame structure having a base generally defining a plane, a first end, and a second end;

c. a can with an electric socket for receiving a light bulb, the can mounted on the frame structure adjacent the first end of the frame structure;

d. a junction box mounted on the frame structure between the second end of the frame structure and the can;

e. a pair of rail pivot assemblies, wherein each rail pivot assembly is attached to each of the support rails, wherein each rail pivot assembly has a pivot pin, wherein the pivot pins define an axis of rotation perpendicular to the length the support rails, and wherein the first end of the frame structure is pivotally connected by the pivot pins of the rail pivot assembly to the pair of support rails; and f. a rail clip attached to the second end of the frame structure, wherein the rail clip is releasably connected directly to the pair of support rails by the rail clip.

2. The pivoting recessed light fixture of claim 1, wherein the rail pivot assembly is slidably connected to the pair of support rails so that the frame structure can be positioned along the of length of the support rails.

3. The pivoting recessed light fixture of claim 1, wherein each rail pivot assembly includes a removable pivot pin for connecting the rail pivot assembly to a first set of matching holes in the frame structure so that the frame structure can be disconnected from the rail pivot assembly, can be rotated horizontally, and can be pivotally reconnected to the rail pivot assembly by means of a second set of matching holes in the frame structure.

4. The pivoting recessed light fixture of claim 1, wherein the can is adjustable connect to the frame structure for movement in the direction normal to the plane of the base of the frame structure.

5. The pivoting recessed light fixture of claim 1, wherein the rail clip comprises a pair of resilient legs that are spreadable for surrounding and releasably engaging the support rail.

6. The pivoting recessed light fixture of claim 1, wherein the rail clip comprises a hook extending from the frame structure and hooking over the support rail.

7. The pivoting recessed light fixture of claim 1, wherein the rail clip is releasably connected to the frame structure.

* * * * *